US009631472B2

(12) United States Patent
Reid et al.

(10) Patent No.: US 9,631,472 B2
(45) **Date of Patent: *Apr. 25, 2017**

(54) INVERTED SHROUD FOR SUBMERSIBLE WELL PUMP

(71) Applicant: Baker Hughes Incorporated, Houston, TX (US)

(72) Inventors: Leslie C. Reid, Coweta, OK (US); Jeffrey S. Bridges, Edmond, OK (US); Brent D. Storts, Piedmont, OK (US)

(73) Assignee: Baker Hughes Incorporated, Houston, TX (US)

( * ) Notice: Subject to any disclaimer, the term of this patent is extended or adjusted under 35 U.S.C. 154(b) by 421 days.

This patent is subject to a terminal disclaimer.

(21) Appl. No.: 14/490,264

(22) Filed: Sep. 18, 2014

(65) Prior Publication Data

US 2015/0053394 A1 Feb. 26, 2015

Related U.S. Application Data

(63) Continuation-in-part of application No. 13/972,599, filed on Aug. 21, 2013.

(51) Int. Cl.
*E21B 43/38* (2006.01)
*E21B 43/12* (2006.01)

(52) U.S. Cl.
CPC ..... *E21B 43/38* (2013.01); *E21B 43/128* (2013.01)

(58) Field of Classification Search
CPC ..... E21B 43/128; E21B 43/38; F04D 7/045; F04D 13/086; F04D 13/10; F04D 29/406; F04D 7/04
See application file for complete search history.

(56) References Cited

U.S. PATENT DOCUMENTS

| | | | |
|---|---|---|---|
| 5,554,897 | A | 9/1996 | Martin |
| 6,412,563 | B1 | 7/2002 | William et al. |
| 6,668,925 | B2 | 12/2003 | Shaw et al. |
| 6,691,782 | B2 | 2/2004 | Vandevier |
| 6,932,160 | B2 | 8/2005 | Murray et al. |
| 7,766,081 | B2 | 8/2010 | Brown et al. |
| 7,810,557 | B2 | 10/2010 | Ives et al. |
| 8,079,418 | B2 | 12/2011 | Brown et al. |

(Continued)

OTHER PUBLICATIONS

PCT Search Report mailed Dec. 23, 2015—S.N. PCT/US2015/050413, Filed Sep. 16, 2015.

*Primary Examiner* — Yong-Suk (Philip) Ro
(74) *Attorney, Agent, or Firm* — Bracewell LLP; James E. Bradley

(57) ABSTRACT

A well pump assembly includes rotary pump and a submersible motor. A shroud surrounds the pump intake and the motor. The shroud has an open upper end in fluid communication with the pump intake. A tubular member of smaller diameter is secured to and extends downward from a lower end of the shroud. The tubular member may have an open lower end for drawing well fluid along a lower flow path up the tubular member to the pump intake. An upper flow path at the upper end of the shroud may have a minimum flow area that is smaller than a minimum flow area of the lower flow path. The tubular member has a smaller outer diameter than an outer diameter of the shroud. The tubular member may have a closed lower end to define a debris collection chamber with a drain valve.

17 Claims, 4 Drawing Sheets

(56) References Cited

U.S. PATENT DOCUMENTS

| | | | | |
|---|---|---|---|---|
| 8,141,625 | B2 | 3/2012 | Reid | |
| 8,397,811 | B2 | 3/2013 | Reid | |
| 8,435,015 | B2 | 5/2013 | Brookbank et al. | |
| 2001/0004017 | A1 | 6/2001 | Lopes | |
| 2003/0141056 | A1* | 7/2003 | Vandevier | E21B 43/38 166/265 |
| 2008/0093085 | A1* | 4/2008 | Knight | E21B 43/38 166/369 |
| 2009/0223662 | A1 | 9/2009 | Shaw | |
| 2012/0211238 | A1 | 8/2012 | Reid et al. | |
| 2012/0263610 | A1 | 10/2012 | Tetzlaff | |
| 2013/0068455 | A1 | 3/2013 | Brown | |

* cited by examiner

INVERTED SHROUD FOR SUBMERSIBLE WELL PUMP

CROSS REFERENCE TO RELATED APPLICATIONS

This application is a continuation-in-part of Ser. No. 13/972,599 filed Aug. 21, 2013.

FIELD OF THE DISCLOSURE

This disclosure relates in general to submersible pumps for wells and in particular to an electrical submersible pump assembly mounted with a shroud assembly having an open upper end.

BACKGROUND

Electrical submersible pumps (ESP) are widely used to pump oil production wells. A typical ESP has a rotary pump driven by an electrical motor. A seal section is located between the pump and the motor to reduce the differential between the well fluid pressure on the exterior of the motor and the lubricant pressure within the motor. A drive shaft, normally in several sections, extends from the motor through the seal section and into the pump for rotating the pump. The pump may be a centrifugal pump having a large number of stages, each stage having an impeller and diffuser. The pump may be other types, such as a progressing cavity pump.

Many wells produce both gas and liquid, such as oil and water. Centrifugal pumps do not function well pumping gas. Some ESP installations have gas separators to remove gas from the well fluid prior to reaching the pump intake. The gas discharges into the well casing and flows up to the wellhead.

Another technique employs a shroud that surrounds the ESP and is supported by the tubing string. The shroud may have an open lower end that is placed below the lowest perforations or openings in the casing. The upper end of the shroud would be closed, requiring all of the well fluid to flow downward alongside the shroud to reach the open lower end. A closed upper end system is usually set below the perforations. As the well fluid flow turns down to flow toward the shroud inlet, some of the gas will separate. The shroud alternately may be inverted with a closed lower end and an open upper end. Typically, the open upper end is positioned above the casing perforations. This placement requires all of the well fluid to flow upward to the open upper end. As the well fluid turns to flow downward into the shroud to the pump intake, some of the gas separates.

The motor of an ESP in a shroud is typically below the pump. If within an inverted shroud, a recirculation tube may be attached to the pump and extend down below the motor to divert some of the well fluid being pumped below the motor. The diverted well fluid flows back alongside the motor to the pump intake, thereby cooling the motor.

While these types of shrouds work well, in some wells the perforations extend over a great distance. If so, it is difficult to position the shroud effectively above or below the perforations. In other wells, the casing perforations or openings may be in a horizontal section, making it difficult to install a shrouded ESP in the horizontal section. The horizontal section may have a smaller diameter casing or liner.

SUMMARY

The well pump assembly disclosed herein includes a pump having a pump intake and a discharge for connection to a string of tubing. A submersible motor is operatively engaged with the pump for driving the pump. A shroud surrounds the pump intake and the motor. The shroud has an open upper end in fluid communication with the pump intake for drawing well fluid along an upper flow path down the shroud into the pump intake. A tubular member extends downward from a lower end of the shroud below the motor. The tubular member has a smaller outer diameter than an outer diameter of the shroud and is in fluid communication with a portion of the shroud surrounding the motor.

In one embodiment, the tubular member has a lower portion that is open for drawing well fluid in. A gas anchor sleeve may surround the lower portion of the tubular member. The gas anchor sleeve has a closed lower end and an open upper end, requiring well fluid flowing up along a lower flow path to flow around the gas anchor sleeve then down between the gas anchor sleeve and the tubular member to reach the open lower portion of the tubular member.

In some of the embodiments, a recirculation tube extends downward within the shroud from a portion of the pump to a point below the motor and above the tubular member. The recirculation tube diverts a portion of the well fluid being pumped by the pump to below the motor.

The embodiments showing a gas anchor sleeve and a recirculation tube may also have a baffle located within the shroud below the recirculation tube and above the tubular member. The baffle is positioned to be struck by the well fluid flowing down the recirculation tube and direct the well fluid back upward.

In other embodiments, the tubular member has a closed lower end, defining a closed chamber for collecting debris from well fluid flowing in the upper end of the shroud. In those embodiments, the tubular member has a drain port. A normally closed valve is located in the tubular member for closing the drain port. The valve is operable to open the drain port while the pump and motor are being retrieved to drain the shroud.

In some of the embodiments, a cylindrical filter is mounted at the upper end of the shroud coaxial with a longitudinal axis of the shroud. The upper flow path leads through the filter.

A debris chamber may optionally be mounted to a lower end of the gas anchor sleeve for collecting debris from well fluid flowing in the upper end of the shroud and in the gas anchor sleeve. The debris chamber has a drain port and a normally closed valve.

For the embodiments having both upper and lower flow paths, a fluid restricting device may be mounted within the shroud above the pump to retard well fluid flow into the upper end of the shroud. Preferably, a minimum flow area of the upper flow path is located in the fluid restricting device and is less than a flow area of the upper flow path in the shroud between the fluid restricting device and the pump intake.

BRIEF DESCRIPTION OF THE DRAWINGS

The present technology will be better understood on reading the following detailed description of nonlimiting embodiments thereof, and on examining the accompanying drawings, in which.

DETAILED DESCRIPTION OF THE DISCLOSURE

Figure 1:
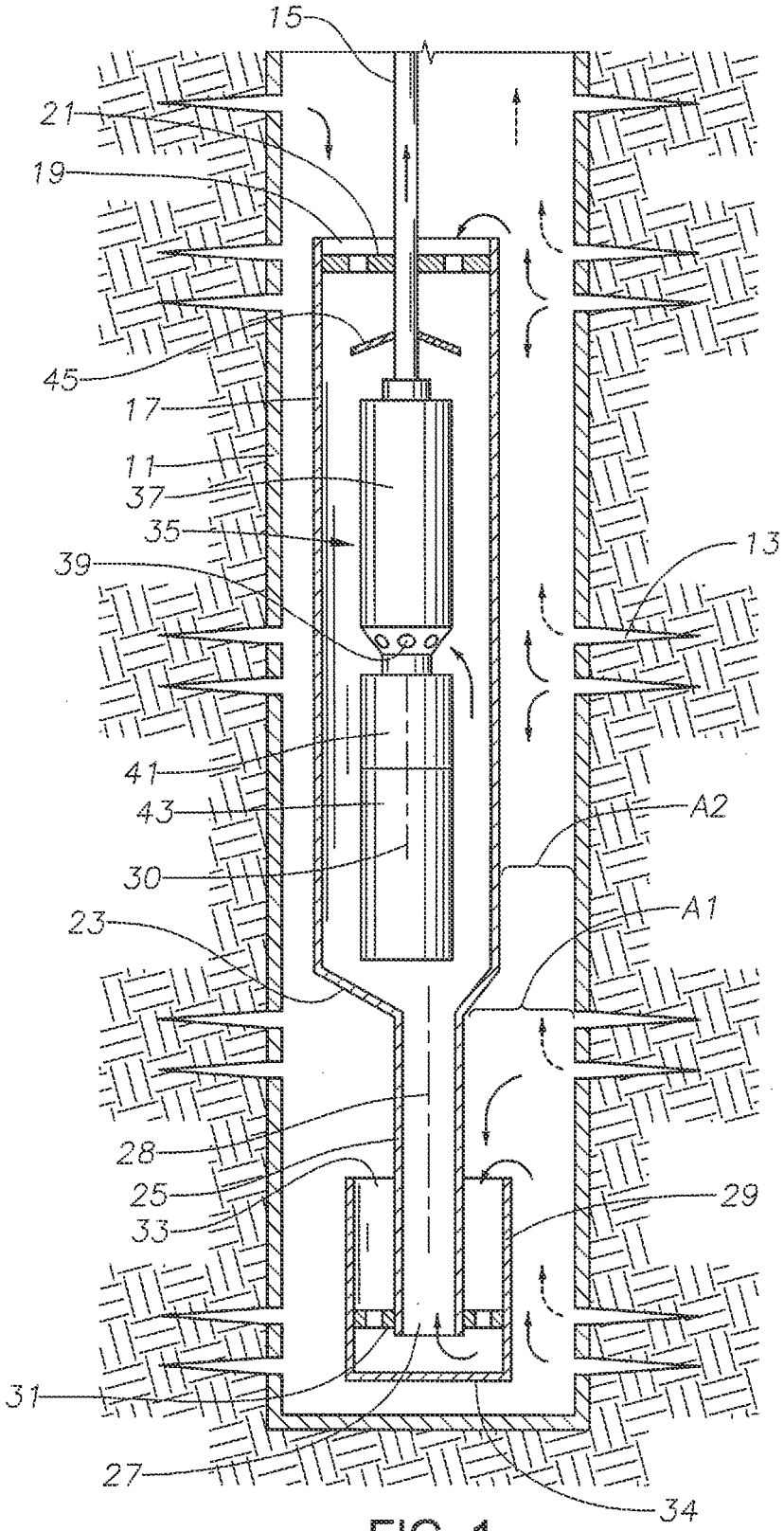
FIG. 1 is a schematic view of well pump assembly in accordance with this disclosure.

The foregoing aspects, features, and advantages of the present technology will be further appreciated when considered with reference to the following description of preferred embodiments and accompanying drawings, wherein like reference numerals represent like elements. In describing the preferred embodiments of the technology illustrated in the appended drawings, specific terminology will be used for the sake of clarity. However, it is to be understood that the specific terminology is not limiting, and that each specific term includes equivalents that operate in a similar manner to accomplish a similar purpose.

Referring to FIG. 1, a well has casing 11 cemented in place. Casing 11 has been perforated, resulting in perforations 13 along a section or sections that may be quite long, such as 500 feet to 2000 feet or more. Although shown as vertical, the sections containing perforations 13 could be inclined. Perforations 13 could be in a horizontal section of the well and could comprise openings from the well for admitting well fluid such as fractures in an open hole, uncased well. The well fluid will likely be a mixture of gas and liquid, such as oil and/or water.

A string of production tubing 15 is supported in casing 11 from a wellhead (not shown). Production tubing 15 may be sections of tubing secured together with threads, or it may be continuous coiled tubing.

Tubing 15 supports a shroud 17, which is a cylindrical tubular member with an open upper end 19. In this example, tubing 15 extends into shroud 17 a selected distance. A hanger 21 secures shroud 17 to tubing 15. Hanger 21 has passages within in it to allow well fluid to flow through hanger 21 and downward in shroud 17. Shroud 17 has a tubular adapter or junction 23 at is lower end that is illustrated as being generally conical and tapers from a larger diameter downward to a smaller diameter.

A dip tube 25 joins shroud 17 at junction 23 and extends downward. Dip tube 25 is also a cylindrical tubular member, but in the preferred embodiment, it has a smaller outer diameter than the minimum outer diameter of shroud 17 at any point along the length of shroud 17. Dip tube 25 has an open lower end 27. Junction 23 seals dip tube 25 to shroud 17 so that any well fluid flowing upward in shroud 17 must first flow through dip tube 25. In the example shown the longitudinal axis 28 of dip tube 25 is offset from the longitudinal axis 30 of shroud 17. Consequently, the larger upper end of junction 23 is laterally offset from the smaller lower end of junction 23. However, longitudinal axis 28 could coincide with the longitudinal axis 30.

The smaller outer diameter of dip tube 25 provides a greater flow area in an annulus A1 between dip tube 25 and casing 11 than in an annulus A2 between shroud 17 and casing 11. The outer diameter of dip tube 25 may be in a range from about 50% to about 65% the outer diameter of shroud 17 in the preferred embodiment. For example, in a well with 7 inch outer diameter casing 11, the outer diameter of shroud 17 might be 5½ inches, and the outer diameter of dip tube 25 between 2⅞ inches and 3½ inches. Casing 11 with a 7 inch outer diameter would have an inner diameter of about 6 inches, making annulus A-1 in the range from 2½ inches to 3⅛ inches in total cross-sectional dimension. Annulus A-2 would have a total cross-sectional dimension of only about ½ inch. Although there is no precise minimum size for the outer diameter of dip tube 25, if made too small, the frictional losses of the fluid flowing up the dip tube 25 would create undesired pressure loss in the dip tube.

Shroud 17 and dip tube 25 comprise a continuous tubular member with openings at lower end 27 and upper end 19 to admit well fluid. Additionally, open lower end 27 is in fluid communication with open upper end 19 via the interior of shroud 17 and dip tube 25. That is, there are no barriers within shroud 17 and dip tube 25 that completely block well fluid flowing into lower end 27 from contact with well fluid flowing into upper end 19 or vice-versa. Dip tube 25 could thus be considered to be a lower portion of shroud 17.

Shroud 17 and dip tube 25 may be lengthy if perforations 13 extend over a long distance. However, it is not necessary that shroud upper end 19 be above the highest perforation 13 or that dip tube lower end 27 be below the lowest perforation 13. It might be desirable in some wells for the combined shroud 17 and dip tube 25 to extend over a large portion of perforations 13. In other wells, such as a vertical well with a horizontal lower section, all of the perforations 13 may be in the horizontal section while shroud 17 and dip tube 25 are entirely in the upper vertical section of the well. Furthermore, shroud 17 could be in the vertical section of the well, and most of the dip tube 25 installed in the horizontal section. In the example shown, some of the perforations 13 are above shroud upper end 19 and some approximately at or below dip tube lower end 27. Shroud 17 may have a greater or lesser length than dip tube 25. Normally, the combined shroud 17 and dip tube 25 extends several hundred feet.

Optionally, a gas anchor sleeve 29 may be mounted around a lower portion of dip tube 25. If dip tube lower end opening 27 is below all of perforations 13, gas anchor sleeve 29 may not be needed. A bracket 31 is illustrated as extending between an inner diameter of gas anchor sleeve 29 and the outer diameter of dip tube 25 to secure gas anchor sleeve 29 to dip tube 25. Bracket 31 has openings through it to allow well fluid to flow downward in the annular space between dip tube 25 and gas anchor sleeve 29. Gas anchor sleeve 29 is a tubular member similar to shroud 17, and may even have the same outer diameter. Gas anchor sleeve 29 has an open upper end 33 and a closed lower end 34. Open upper end 33 is above dip tube lower end 27 and below junction 23. Closed lower end 34 is a short distance below dip tube lower end 27. The annular flow area between dip tube 25 and gas anchor sleeve 29 is preferably at least equal to the cross-sectional flow area of dip tube open end 27. Alternately, rather than the extreme lower end of dip tube 25 being open, the term "open lower end 27" includes holes within the side wall of dip tube 25 at a point below gas anchor upper end 33. If holes in the side wall of dip tube 25 are employed, the extreme lower end of dip tube 25 could be closed or joined to gas anchor lower end 34. The length of gas anchor sleeve 29 may vary, but it is typically less than the length of dip tube 25 so as to provide a length of the larger dimension casing annulus A1 as long as possible. Normally, the upper end 33 of gas anchor sleeve 29 will be above some of the perforations 13.

Production tubing 15 also supports a pump that is at least partially inside shroud 17, which in the embodiment shown is an electrical submersible pump assembly (ESP) 35. ESP 35 includes a pump 37, illustrated as a centrifugal pump, having a discharge connected to production tubing 15 for pumping well fluid up tubing 15. An intake 39 of pump 37 is located below shroud upper end 19. Pump 37 may be a centrifugal type or some other pump, such as a progressing cavity pump. A seal section 41 couples pump 37 to a motor 43. Motor 43 is preferably a three-phase electrical motor filled with a dielectric lubricant. A power cable including a motor lead (not shown) is strapped along tubing 15 and extends within shroud 17 to motor 43. Seal section 41 is a conventional device that reduces a pressure differential between the lubricant in motor 43 and the well fluid. The lower end of motor 43 may have a sensor unit mounted to it. Normally ESP 35 has a larger outer diameter than the inner diameter of dip tube 25, and the lower end of ESP 35 will located near junction 23.

A flow restrictor 45 optionally may be located within shroud 17 to provide a minimum flow area along an upper flow path down shroud 17 to pump intake 39. Alternately, the minimum flow area could be the annular space between pump 37 and shroud 17. In some instances, hanger 21 will serve as a flow restrictor and provide all the flow restriction needed, eliminating a need for a separate flow restrictor 45. Flow restrictor 45 is schematically shown in FIG. 1 as an immovable baffle that secures around production tubing 15 and has an outer diameter less than the inner diameter of shroud 17. The annular space between the outer diameter of flow restrictor 45 and shroud 17 provides a minimum flow area for well fluid to flow downward, particularly liquid well fluid. Flow restrictor 45 could also have passages within it that allow well fluid to flow downward.

The flow area provided by flow restrictor 45 would normally be less than the annular flow area at any point along the upper flow path between the upper end 19 of shroud 17 and pump intake 39. The minimum flow area in the upper flow path from shroud upper end 19 to pump intake 39 is preferably less than the minimum flow area in the lower flow path from gas anchor sleeve upper end 33 to dip tube open lower end 27 and up dip tube 25.

In operation, the operator assembles gas anchor sleeve 29 with dip tube 25 and dip tube 25 with shroud 17. The operator lowers ESP 35 into shroud 17 either after shroud 17 is fully assembled or while shroud 17 is being assembled. The operator secures shroud 17 to production tubing 15 with hanger 21 and lowers the entire assembly into casing 11 with production tubing 15. The operator will position the assembly at a desired location relative to perforations 13. Normally, the operator will want to place pump intake 39 as low as possible relative to perforations 13, to assure a liquid level above pump intake 39 during operation. In some wells, some perforations 13 may be at or below gas anchor sleeve 29 and some above shroud upper end 19. Casing 11 would normally have a static level of well fluid liquid that is above pump intake 39, but the static level might not be above all of the perforations 13. The lower end 27 of dip tube 25 will be submersed in the static liquid in casing 11, and possibly the upper end 19 of shroud 17 will also be submersed in the static liquid in casing 11, depending upon the well. Axis 28 of dip tube 25 could be offset from the axis of casing 11 or it could be generally centered.

The operator supplies electrical power to motor 43 via the power cable (not shown). Pump 37 will operate to draw well fluid into pump intake 39. As illustrated, the well fluid contains gas (dotted arrows) and liquid (solid arrows). The gas and liquid tend to separate as the well fluid flows from perforations 13, with gas flowing upward relative to the liquid because of its lighter gravity. Gas released in casing 11 will flow up to the wellhead and out a flow line. Some of the liquid will flow downward to gas anchor open upper end 33. That well fluid, which is predominately liquid, flows up dip tube 25 to pump intake 39. Well fluid flowing from perforations 13 below gas anchor open upper end 33 will encounter additional gas separation where the well fluid turns and flows downward into gas anchor open upper end 33. The liquid tends to flow downward in gas anchor open upper end 33, while the gas flows upward.

Liquid from perforations 13 above shroud 17, if any, will flow downward into shroud open upper end 19 to pump intake 39. Some of the liquid flowing from perforations 13 below shroud open upper end 19 but closer to shroud open upper end 19 than gas anchor 29 may flow upward in the annulus A2 between shroud 17 and casing 11 along with the gas. That liquid would turn and flow downward into shroud open upper end 19, further releasing gas.

Generally, the faster the flow rate, the more likely liquid will be entrained in the gas flow. An advantage of the larger casing annulus A1 is that the flow speed through this area will be less than the flow speed through the smaller casing annulus A2. Consequently, liquid produced from perforations 13 in larger casing annulus A1 is more likely to separate from the gas and flow downward, rather than upward. Liquid produced from perforations 13 in smaller casing annulus A2 may be more likely to be entrained with and flow upward along with the gas until reaching shroud upper end 19. Some of the liquid produced in perforations 13 in smaller casing annulus A2 may flow upward, and some may flow downward.

Preferably, a greater flow speed of liquid (e.g. linear feet per second) occurs in the lower flow path from gas anchor open end 33 down and up through dip tube 25 to pump intake 39 than in the upper flow path down shroud upper end 19 to pump intake 39. The greater flow speed assists in providing an adequate flow of liquid well fluid past motor 43 for cooling. The greater flow rate is assisted by making the minimum flow area along the lower flow path for liquid flowing up dip tube 25 greater than the minimum flow area for liquid flowing downward along the upper flow path and passing downward through flow restrictor 47. The minimum flow area along the upper flow path could be at hanger 21, at flow restrictor 45, if employed, or in the annulus between pump 37 and shroud 17. The minimum flow area along the lower flow path could be the annulus between dip tube 25 and gas anchor sleeve 29, at bracket 31 or in the opening 27 in dip tube 25.

Figure 2:
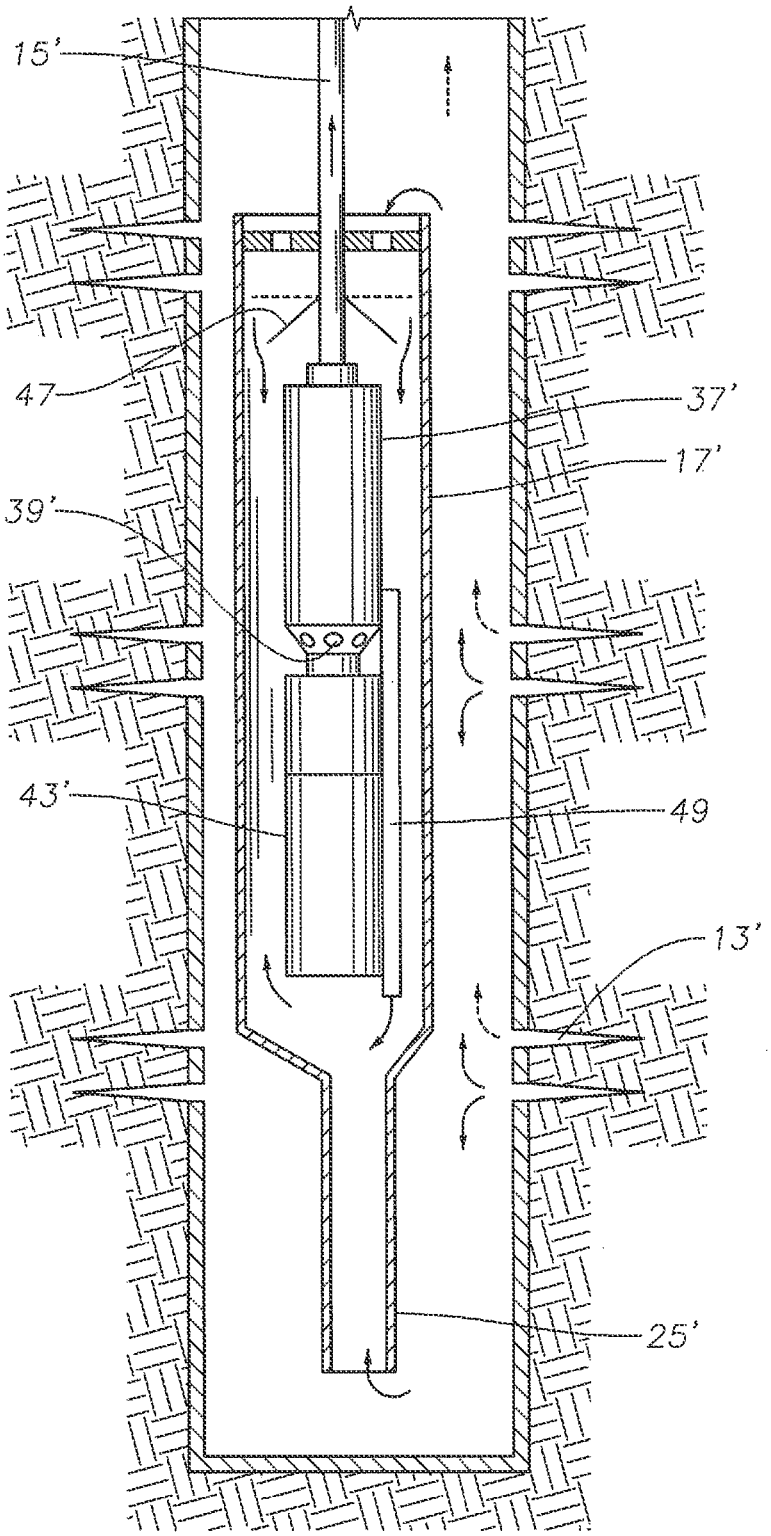
FIG. 2 is a schematic view of a second embodiment of well pump assembly.

Referring to FIG. 2, components discussed that are the same as in the FIG. 1 embodiment may use the same numerals, but with a prime symbol. In the embodiment of FIG. 2, gas anchor sleeve 29 is not used. One reason is that dip tube 25' extends lower than the lowest perforation 13', making it less likely for gas to enter dip tube 25'. Flow restrictor 47 may provide a minimum flow area as does flow restrictor 45.

In this embodiment, flow restrictor 47 is movable, having pivotal sections, making it operate similar to a check valve or a flapper valve. As indicated by the dotted lines, at least part of flow restrictor 47 pivots downward or moves to a more open position to allow downward well fluid flow. Flow restrictor 47 pivots upward to a more restrictive position to reduce upward flow of well fluid if the well fluid flowing pressure below flow restrictor 47 becomes greater than the pressure above. Normally, the flow would be only downward. However, a large gas bubble could possibly enter dip tube 25' and tend to blow the liquid in dip tube 25' and shroud 17' upward out of shroud 17'. In response, flow restrictor 47 would move to the more restrictive position illustrated by the dotted lines, retarding upward flow of liquid. In the more restrictive position, flow restrictor 47 would not seal completely to shroud 17' so as to allow the gas bubble below to dissipate upward out of shroud 17'. Pivotal flow restrictor 47 would also have to accommodate the power cable passing downward to motor 43'. A pivotal restrictor 47 could alternately be employed in the FIG. 1 embodiment in place of the immovable flow restrictor 45.

In addition, in the second embodiment, a recirculation tube 49 provides enhanced cooling for motor 43'. Recirculation tube 49 has an upper end extending through the housing of pump 37' at a selected point between intake 39' and the upper end of pump 37'. Some of the liquid being pumped will be diverted out of pump 37' and down recirculation tube 49. The lower end of recirculation tube 49 is below the lower end of motor 43'. The recirculated well fluid flows back up shroud 17' past motor 43' to pump intake 39'.

Figure 3:
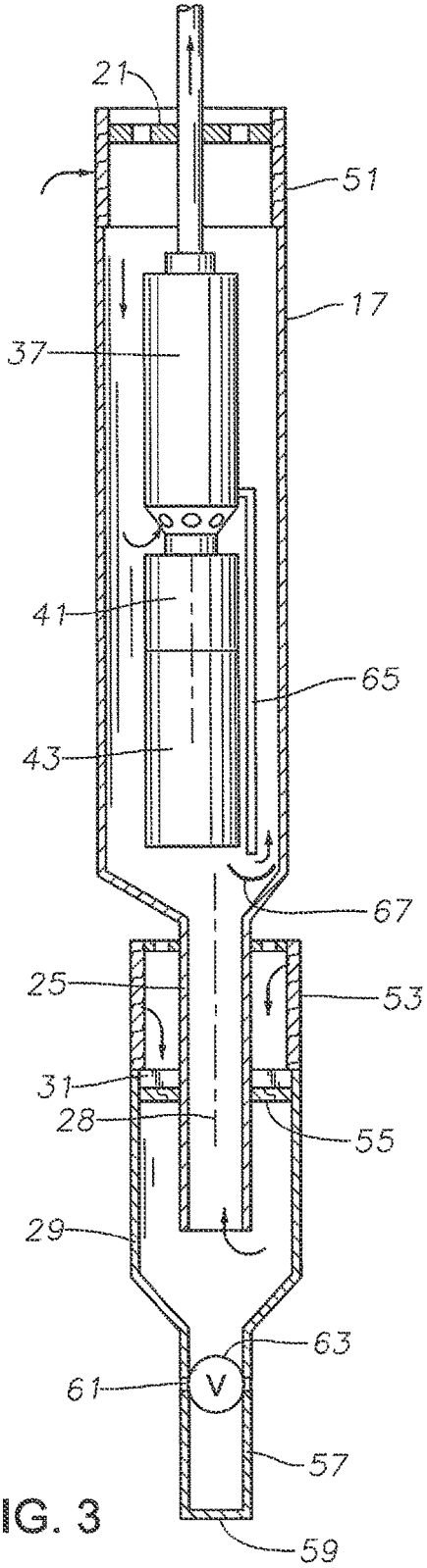
FIG. 3 is a schematic view of a third embodiment of a well pump assembly.

FIG. 3 illustrates an alternate embodiment of the assembly of FIG. 1. Components that are the same in both embodiments may employ the same reference numerals. A cylindrical upper filter 51 is located at the upper end of shroud 17. Filter 51 is concentric with shroud axis 28, and most of the well fluid flowing in the upper portion of shroud 17 will flow through upper filter 51. If hanger 21 has openings, a filter (not shown) may also be combined with hanger 21. A cylindrical, coaxial lower filter 53 is located at the upper end of gas anchor sleeve 29. An additional lower filter 55 may be located at gas anchor sleeve bracket 31.

Another tubular member, referred to herein as debris chamber 57, extends downward from gas anchor sleeve 29. Debris chamber 57 may have an outer diameter smaller than gas anchor sleeve 29 and approximately the same as dip tube 25. Debris chamber 57 has a closed lower end 59 for collecting sand and other debris that is able to flow through lower filters 53, 55 and upper filter 51. The length of debris chamber 57 may vary, but typically would be greater than 10 feet.

A drain port 61 is located within debris chamber 57, and in this example, drain port 61 is closer to the upper end of debris chamber 57 than lower end 59. A drain valve 63 is normally closed and may be opened when shroud 17 is retrieved along with pump 37, seal section 41, and motor 43. Preferably drain valve 63 is a type that is opened by dropping a bar down the open upper end of shroud 17 after pump 37, seal section 41 and motor 43 have been removed and shroud 17 is suspended at the upper end of the well. After shroud 17 has been drained and completely removed from the well, a technician may open lower end 59 to remove collected sand and debris.

The embodiment of FIG. 3 may also have a recirculation tube 65 similar to recirculation tube 49 of FIG. 2. The lower end of recirculation tube 65 is below motor 43 and above dip tube 25. A bowl-shaped baffle 67 is mounted directly below the lower end of recirculation tube 65. Baffle 67 has a concave portion that faces to re-direct well fluid being discharged by recirculation tube 65 back upward. The embodiment of FIG. 3 does not employ a barrier such as flow restrictor 45 of FIG. 1.

Figure 4:
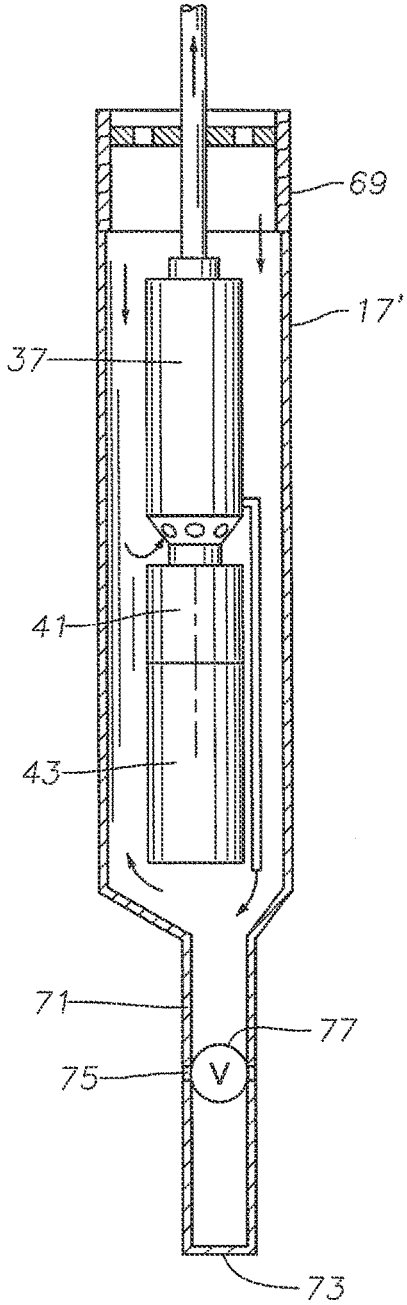
FIG. 4 is a schematic view of a fourth embodiment of a well pump assembly.

FIG. 4 illustrates an alternate embodiment of the assembly of FIG. 2. Components that are the same in both embodiments may employ the same reference numerals. A cylindrical filter 69 similar to upper filter 51 of FIG. 3 is at the open upper end of shroud 17'. Rather than dip tube 25' (FIG. 2), a debris chamber 71 extends downward from the lower end of shroud 17'. Debris chamber 71 is a tubular member with a closed lower end 73, similar to debris chamber 57 of FIG. 3. Debris chamber 71 has a drain port 75 and drain valve 77 that function in the same manner as drain port 61 and drain valve 63 of FIG. 3. Debris chamber 71 preferably has an outer diameter smaller than the outer diameter of shroud 17', such as less than 65% of that outer diameter.

Unlike the embodiment of FIGS. 1-3, there is no lower flow path in the embodiment of FIG. 4; all of the well fluid flows into the upper end of shroud 17'. Also, there is no flow restrictor such as flow restrictor 47 of FIG. 2.

Figure 5A:
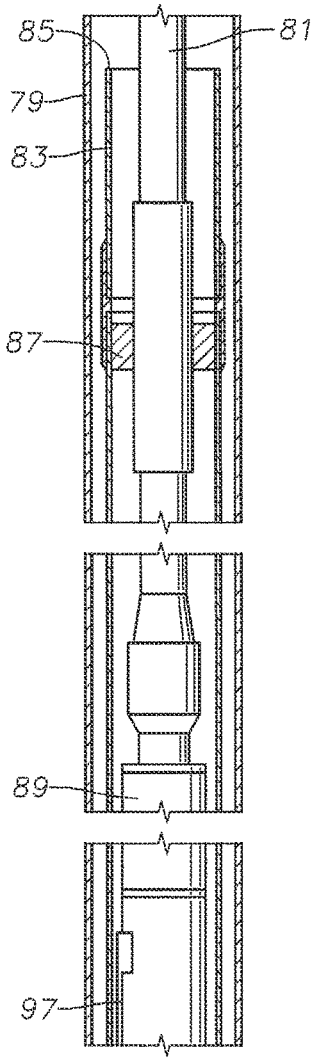
FIGS. 5A, 5B and 5C comprises a side view, partially sectioned, of a fifth embodiment of a well pump assembly.
Figure 5B:
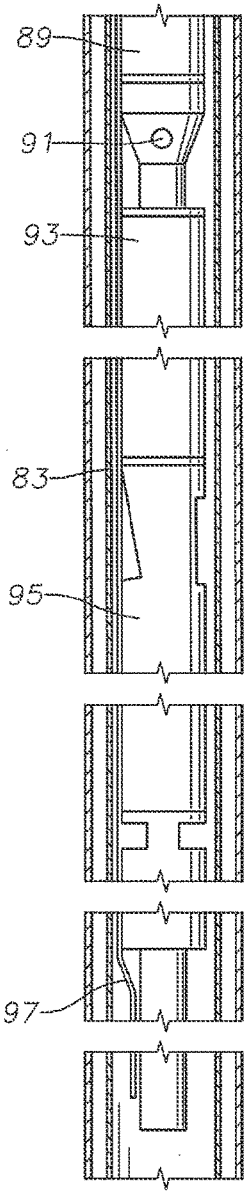
Figure 5C:
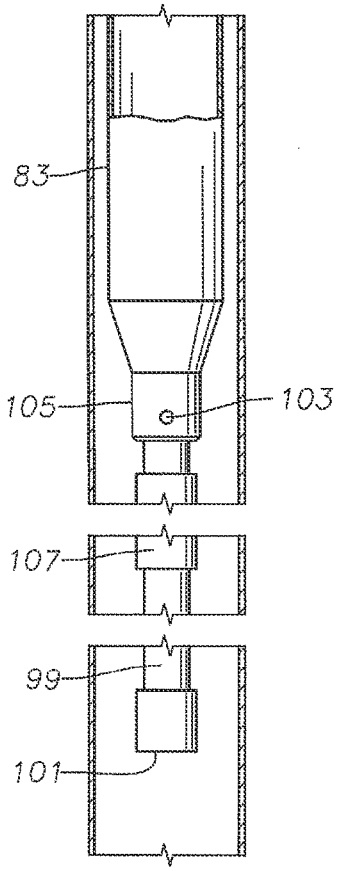

FIGS. 5A, 5B and 5C comprise a more detailed drawing of an assembly that is similar to the one shown in FIG. 4. A well has conventional casing 79 and a string of production tubing 81. Production tubing 81 supports a shroud 83 having an open upper end 85. Hanger 87 connects shroud 83 to a portion of production tubing 81 and allows downward flow of well fluid in shroud 83.

Production tubing 81 also supports within shroud 83 a pump 89 having an intake 91. A seal section 93 connects to intake 91 and to an electrical motor 95. A recirculation tube 97 extends from one of the stages of pump 89 to a point below motor 95. A tubular member that serves as a debris chamber 99 extends downward from the lower end of shroud 83. A threaded lower cap 101 closes the lower end of debris chamber 99 during operation. Debris chamber 99 has a drain port 103 and a drain valve 105 that function in the same manner as drain port 61 and drain valve 63 of FIG. 3. If desired, a conventional tubing collar 107 may connect more than one section of conventional tubing together to make up a desired length for debris chamber 99.

Although the technology herein has been described with reference to particular embodiments, it is to be understood that these embodiments are merely illustrative of the principles and applications of the present technology. It is therefore to be understood that numerous modifications may be made to the illustrative embodiments and that other arrangements may be devised without departing from the spirit and scope of the present technology.

The invention claimed is:

1. A well pump assembly, comprising:

a pump having a pump intake and a discharge above the pump intake for connection to a string of production tubing;

a submersible motor operatively engaged with the pump below the pump for driving the pump;

a shroud surrounding the pump intake and the motor, the shroud having an open upper end in fluid communication with the pump intake for drawing well fluid along an upper flow path down the shroud into the pump intake;

a tubular member extending downward from a lower end of the shroud below the motor and having a smaller outer diameter than an outer diameter of the shroud, the tubular member being in fluid communication with a portion of the shroud surrounding the motor;

a gas anchor sleeve surrounding the lower portion of the tubular member, the gas anchor sleeve having a closed lower end below the lower portion of the tubular member, and the gas anchor sleeve having an open upper end, requiring well fluid flowing up along a lower flow path to flow around the gas anchor sleeve then down between the gas anchor sleeve and the tubular member to reach the open lower portion of the tubular member;

a debris chamber mounted to a lower end of the gas anchor sleeve for collecting debris from well fluid flowing in the upper end of the shroud and in the gas anchor sleeve;

a drain port in the debris chamber; and a normally closed valve in the debris chamber for closing the drain port, the valve being operable to open the drain port while the pump and motor are being retrieved to drain the shroud.

2. The assembly according to claim 1, further comprising:

a cylindrical filter at the upper end of the shroud mounted coaxially with a longitudinal axis of the shroud; and wherein the upper flow path leads through the filter.

3. The assembly according to claim 1, further comprising:

a fluid restricting device within the shroud above the pump to retard well fluid flow into the shroud; wherein a minimum flow area of the upper flow path is located in the fluid restricting device and is less than a flow area of the upper flow path in the shroud between the fluid restricting device and the pump intake.

4. The assembly according to claim 1, wherein the outer diameter of the tubular member is less than 65% of the outer diameter of the shroud.

5. A well pump assembly, comprising:

a pump having a pump intake and a discharge for connection to a string of tubing;

a submersible motor operatively engaged with the pump for driving the pump;

a shroud surrounding the pump intake and the motor, the shroud having an open upper end in fluid communication with the pump intake for drawing well fluid along an upper flow path down the shroud into the pump intake;

a tubular member extending downward from a lower end of the shroud below the motor and having a smaller outer diameter than an outer diameter of the shroud, the tubular member being in fluid communication with a portion of the shroud surrounding the motor; and a recirculation tube extending downward within the shroud from a portion of the pump to a point below the motor and above the tubular member, the recirculation tube diverting a portion of the well fluid being pumped by the pump to below the motor.

6. The assembly according to claim 5, wherein the tubular member has a lower portion that is open for drawing well fluid in, and wherein the assembly further comprises:

a gas anchor sleeve surrounding the lower portion of the tubular member, the gas anchor sleeve having a closed lower end below the lower portion of the tubular member, and the gas anchor sleeve having an open upper end, requiring well fluid flowing up along a lower flow path to flow around the gas anchor sleeve then down between the gas anchor sleeve and the tubular member to reach the open lower portion of the tubular member.

7. The assembly according to claim 5, wherein:

the tubular member has a closed lower end, defining a closed chamber for collecting debris from well fluid flowing in the upper end of the shroud;

the tubular member has a drain port; and a normally closed valve is located in the tubular member for closing the drain port, the valve being operable to open the drain port while the pump and motor are being retrieved to drain the shroud.

8. A well pump assembly, comprising:

a pump having a pump intake and a discharge for connection to a string of tubing;

a submersible motor operatively engaged with the pump for driving the pump;

a shroud surrounding the pump intake and the motor, the shroud having an open upper end in fluid communication with the pump intake for drawing well fluid an upper flow path down the shroud into the pump intake;

a dip tube secured to and extending downward from a junction with a lower end of the shroud, the dip tube being in fluid communication with the pump intake and having an open lower end for drawing well fluid along a lower flow path up the dip tube to the pump intake;

wherein the upper flow path has a minimum flow area that is smaller than a minimum flow area of the lower flow path; and a gas anchor sleeve surrounding a lower portion of the dip tube, the gas anchor sleeve having a closed lower end below the open lower end of the dip tube, and the gas anchor sleeve having an open upper end, requiring well fluid flowing up around the gas anchor sleeve along the lower flow path to flow down between the gas anchor sleeve and the dip tube to reach the open lower end of the dip tube.

9. The assembly according to claim 8, further comprising:

a fluid restricting device within the shroud above the pump to retard well fluid flow into the shroud; wherein the minimum flow area of the upper flow path is located in the fluid restricting device and is less than a flow area of the upper flow path in the shroud between the fluid restricting device and the pump intake.

10. The assembly according to claim 8, further comprising:

a recirculation tube extending downward within the shroud from a portion of the pump to a point below the motor and above the dip tube, the recirculation tube diverting a portion of the well fluid being pumped by the pump to below the motor.

11. The assembly according to claim 8, further comprising:

a movable flow restricting device within the shroud above the pump to enhance well fluid flow up the dip tube, the movable flow restricting device having a first position admitting downward flow of well fluid along the upper flow path in the shroud and being movable to a second position retarding upward flow of well fluid in the shroud.

12. The assembly according to claim 8, further comprising:

a debris chamber mounted to a lower end of the gas anchor sleeve for collecting debris from well fluid flowing in the upper end of the shroud and in the gas anchor sleeve;

a drain port in the debris chamber; and a normally closed valve in the debris chamber for closing the drain port, the valve being operable to open the drain port while the pump and motor are being retrieved to drain the shroud.

13. The assembly according to claim 8, further comprising:

a recirculation tube extending downward within the shroud from a portion of the pump to a point below the motor and above the dip tube, the recirculation tube diverting a portion of the well fluid being pumped by the pump to below the motor;

a debris chamber mounted to a lower end of the gas anchor sleeve for collecting debris from well fluid flowing in the upper end of the shroud and in the gas anchor sleeve;

a drain port in the debris chamber; and a normally closed valve in the debris chamber for closing the drain port, the valve being operable to open the drain port while the pump and motor are being retrieved to drain the shroud.

14. A well pump assembly, comprising:

a pump having a pump intake and a discharge for connection to a string of tubing;

a submersible motor operatively engaged with the pump for driving the pump;

a shroud surrounding the pump intake and the motor and adapted to be supported by the string of tubing, the shroud having an open upper end for drawing well fluid down an upper portion of the shroud into the pump intake;

a tubular member extending downward from a lower end of the shroud below the motor and having a smaller outer diameter than an outer diameter of the shroud, the tubular member being in fluid communication with a portion of the shroud surrounding the motor;

a closed lower end on the tubular member, defining a closed chamber for collecting debris from well fluid flowing in the upper end of the shroud;

a drain port located in the tubular member; and a normally closed valve for closing the drain port, the valve being operable to open the drain port while the pump and motor are being retrieved to drain the shroud.

15. The assembly according to claim 14, further comprising:

a recirculation tube extending downward within the shroud from a portion of the pump to a point below the motor and above the tubular member, the recirculation tube diverting a portion of the well fluid being pumped by the pump to below the motor.

16. The assembly according to claim 14, wherein the closed lower end of the tubular member comprises a threaded cap that is selectively removable while the shroud is retrieved to remove debris from the chamber.

17. The assembly according to claim 14, further comprising:

a cylindrical filter at the upper end of the shroud mounted coaxially with a longitudinal axis of the shroud; and wherein a flow path for the well fluid leads through the filter.

* * * * *